US006964239B2

(12) United States Patent
Vinnik

(10) Patent No.: US 6,964,239 B2
(45) Date of Patent: Nov. 15, 2005

(54) MODULAR FLOATING BOAT LIFT

(75) Inventor: Daniel M. Vinnik, Boca Raton, FL (US)

(73) Assignee: Boatfloat LLC, Boca Raton, FL (US)

( * ) Notice: Subject to any disclaimer, the term of this patent is extended or adjusted under 35 U.S.C. 154(b) by 0 days.

(21) Appl. No.: 10/216,689

(22) Filed: Nov. 13, 2002

(65) Prior Publication Data

US 2004/0089212 A1 May 13, 2004

(51) Int. Cl.[7] ..... B63C 7/00
(52) U.S. Cl. ..... 114/44; 405/3
(58) Field of Search ..... 114/263, 44, 45, 114/48, 49, 267; 405/3, 4

(56) References Cited

U.S. PATENT DOCUMENTS 4,018,179 A * 4/1977 Rutter ..... 114/45
4,850,741 A * 7/1989 Timmerman ..... 405/3
4,895,479 A * 1/1990 Michaelsen et al. ..... 405/3
5,355,825 A * 10/1994 Lefebvre et al. ..... 114/267
5,485,798 A * 1/1996 Samoian et al. ..... 114/44
5,919,000 A * 7/1999 Unkle ..... 405/3
5,931,113 A * 8/1999 Eva, III et al. ..... 114/263
6,138,599 A * 10/2000 Elson ..... 114/263
6,575,661 B1 * 6/2003 Phillips et al. ..... 405/3
6,592,291 B2 * 7/2003 Foxwell ..... 405/1
2002/0170479 A1 * 11/2002 Elson et al. ..... 114/44

* cited by examiner

*Primary Examiner*—Andrew D. Wright
(74) *Attorney, Agent, or Firm*—Jon A. Gibbons; Fleit, Kain, Gibbons, Gutman, Bongini & Bianco P.L.; Robert J. Van der Wall

(57) ABSTRACT

The present invention relates to a boat lift including a base structure a cradle connected with the base structure and configured to support a boat, and a plurality of pontoons connected with the base structure for floating the boat lift on a water surface. The pontoons include a plurality of modular floats such that boats of varying weights are lifted and boats of varying centers of gravity are lifted levelly. The present invention also relates to a method of employing the boat lift.

18 Claims, 5 Drawing Sheets

MODULAR FLOATING BOAT LIFT

BACKGROUND OF THE INVENTION

1. Field of the Invention

The present invention relates to the field of boat docking, and specifically concerns a modular boat lift which is supported by floating it on the water surface using side pontoons comprised of modular floats 2. Description of the Prior Art The mooring of a boat or ship at a dock with the use of mooring lines has been known for hundreds of years. But it was not until the relatively recent past that means became available to readily raise a boat out of the water when not in use. Since the typical pleasure boat spends nearly its entire life not in use, it is highly desirable to remove the boat hull and running gear from the water whet it is not being used. This is true regardless of whether the boat is in fresh water or salt water. In fresh water algae tends to grow on the hull, while in salt water there is the growth of barnacles and other types of sea life on the hull and electrolysis often harms metal components of the boat, e.g., propellers, shafts, trim tabs, rudders and engine seals.

A great variety of devices have been employed for this purpose. One device uses davits on a dock or seawall in which books are attached to cleats on the boat and cables connected to a winch powered by electric motors that then lift the boat out of the water by brute force. It is also quite commonly known that these devices are ugly, fairly noisy, and are very dangerous if a cable parts. As a consequence, many residential communities do not permit their use.

There are a variety of patented devices that have been used to lift boats from the water. An example is Dettlang, Jr., U.S. Pat. No. 5,238,324, which teaches a combination wheeled boat dock and lift by which a boat is virtually driven around a body of water. Another example is Thomas, U.S. Pat. No. 4,686,920, which teaches a cradle type of device submerged in the water between pilings and then lifted using block and tackle powered by an electric motor. Another example is Sackett, U.S. Pat. No. 5,131,342, which discloses a shallow draft floating boat lift which employs two pontoon type flotation chambers on either side of the hull wherein lift is created using jack screws powered by electric motors.

The general concept of the use of flotation devices in combination with mechanical apparatus to achieve lifting a boat from the water, as in the present invention, is known. An example is Gates, U.S. Pat. No. 6,032,601, which also employs pontoons on either side of the boat with a cradle therebetween. However, this reference significantly differs from the present invention, in part because this reference employs pivoting arm structures and a drive mechanism that use potentially dangerous and noisy cables to raise the boat relative to the pontoons so that the hull emerges from the water. Other distinctions with this reference will become apparent upon review of the following detailed descriptions of the present invention.

Another prior art reference is Dickman, U.S. Pat. No. 5,979,349, which uses a tank with air and water levels in that tank being adjustable to raise and lower the lift. However, it also employs a dock attached jackscrew to reduce and minimize listing of the boat bull and adjusting air tube that allegedly affects listing as well.

Another approach is to employ a floating platform having a v-shape in the center thereof, a series of rollers at the bottom of the V-shape corresponding to the position of a keel on a V-hull and a winch with is capable of pulling the boat out of the water and on to the top of what amounts to a floating dock. This approach is taught by Hillman, et al, in U.S. Pat. No. 6,006,687.

Some prior art devices have used means of changing buoyancy of certain components to achieve submergence and lifting. An example of that approach is a patent issued to Siegmann, U.S. Pat. No. 6,257,159, which is an apparatus for raising and lowering boats in water that has the capability of lifting a center keel sailboat completely out of the water. It employs flotation tanks or chambers that are alternately flooded or evacuated using compressed air and which further employs an elaborate structure of eight traction mechanisms in the form of reels and apparent cables to assist in the lift effort. Siegmann represents a very complex invention.

Moody, U.S. Pat. No. 5,860,379, teaches an inflatable floating boat lift device constructed of a flexible impermeable fabric comprising main air chambers and a network of hoses and blowers which control the inflation and deflation of each main chamber independently. This device provides vertical lifting of the boat while floating on the surface of the water. The blower is operated either by 115 volt AC, or 12 or 24 volt DC power.

A further reference of interest that is somewhat older is Bradfield, U.S. Pat. No. 3,967,570, which is a floating boat dock lift that employs a variable buoyancy chamber connected to an air pump and valves. It also employs a hinged structure to the dock.

Yet another reference is that of Samoian, et al., U.S. Pat. No. 5,485,798, which discloses a floating boat lift supported by side pontoons and having a cradle lifted by the operation of hydraulic cylinders that employ water rather than hydraulic fluid, and use a parallelogram linkage in combination with the hydraulic cylinders. Samoian, et al. does not teach the modular concept or any other means to expand its boat weight handling capability.

Accordingly, what is needed is a method and apparatus to overcome some of the shortcomings and problems with the prior art. Particularly, what is needed is a boat lift with the ability to expand the size of boat lift while offering at the same time simplicity, silent operation, and low visibility of the present invention. The latter features are important because in many communities, boat lift devices are banned because of their unsightliness, potential pollution considerations, consumption of space, use of water contaminating underwater devices, noise and for numerous other reasons. Noise is a consideration because the prior art that uses buoyancy tanks does so with air pumping devices such as vacuum cleaner pumps and motors that are notoriously noisy.

SUMMARY OF THE INVENTION

The present invention is an improvement patent over Samoian, et al. in that it employs a modular concept regarding many of its parts to allow the boat lift to be varied to accommodate heavier boats without having to be completely replaced. This concept is important because the typical boat owner keeps buying bigger and heavier boats as time goes by, and the present invention is focused on the means to accommodate such growth in boat weight without requiring replacement boat lift.

The lift mechanism includes a parallelogram linkage supporting a cradle. The structure, in addition to the floats, is also modular or adjustable so that the capacity of the lift is readily alterable to accommodate heavier or lighter boats, and this is done in the field.

The parallelogram linkage is pivoted into a flattened configuration when a boat is being launched. The cradle portion of the modular boat lift mechanism includes surfaces known as boat bunks, normally covered with carpet, which contact the boat hull and raise it silently out of the water by the use of the parallelogram linkage when latter is pivoted into its expanded configuration by at least one aqueous hydraulic cylinder, but almost invariably a plurality thereof. The power source for the aqueous hydraulic cylinders is a conventional hose bib and water pump and accompanying controls. The use of household water is preferred, but ambient water is useable also.

Significant resulting advantages of the invention are (1) that the modular boat lift is modified in size in the field to accommodate heavier or lighter boats (2) taken in combination with point (1) there is no aspect of the structure which contaminates environmentally sensitive waters because the power source uses only ambient or household water to operate the hydraulic cylinders, not hydraulic fluid, and (3) taken in combination with point (1) that the operation of the modular boat lift is almost totally silent because the only sound is that of a water pump, and even that sound is muffled when placed in a acoustically insulated dock box. The modified boat lift is so quiet in operation that it is equipped with a strobe light to signal that it is in operation.

The inventive modular boat lift is simply towed to its operating locale and either secured to a dock with conventional mooring lines and/or otherwise secured with eyelets attached to pilings, bulkheads, or other waterside structures. Alternative means to position the lift are also envisioned, even one or more anchors. This avoids the construction of unsightly permanent structures such as davits at the waterside and minimizes or eliminates the expense and delay involved in securing regulatory approval for the construction of such permanent structures. When a size change is needed, the modular boat lift is raised out the water on site, the size changes made, and the lift returned to the water on site. This requires lifting equipment on site. More commonly the lift is towed to a boat yard equipped with a travelift.

The modular boat lift features a low profile because the lift mechanism is submerged when not in use. This leaves only modular float pontoons supporting the boat lift, its mooring lines, and its water pump power source dock box visible, except when a boat has been lifted out of the water. Further, even when the lift is in use supporting a boat out of the water, it is also relatively low profile because the cradle is smaller than the length and beam dimensions of the boat hull and only the upper portions of the expanded parallelogram linkage are visible.

Bearing in mind the foregoing, the present invention provides a modularly expandable, submerged pontoon supported boat lift apparatus and method that, except for the pontoons, mooring lines, and a dock box, is of very low visibility, with the lift mechanism itself being submerged beneath the water surface, except for boat bunks and about six (6) inches of lifting lever being barely visible when supporting a boat out of the water.

In one embodiment, the present invention provides a modularly expandable, pontoon supported submerged boat lift apparatus and method which employs nothing that contaminates or fouls the water in which it is operated.

In another embodiment, the present invention provides a modularly expandable pontoon supported submerged boat lift apparatus and method which employs very few moving parts, those being a water pump, four solenoid valves, aqueous hydraulic cylinders and locking mechanisms attached to each cylinder.

In a further embodiment, the present invention provides a modularly expandable pontoon supported submerged boat lift that employs as a power source, household water, or optionally the very same ambient water in which the apparatus is deployed.

In another embodiment, the present invention employs inert materials in the water which do not foul the environment, or require maintenance in a modularly expandable boat lift.

In a further embodiment, the present invention provides a modularly expandable pontoon supported submerged boat lift which requires no special mechanism for affixing to the dock in that it is simply tied to a boat dock with mooring lines in the same manner as a boat, which results in part from the invention's level lift capability.

The present invention also provides a modularly expandable pontoon supported submerged boat lift having level lift capability because the pontoons are moveable in the field to accommodate a differing CG in different boats.

In a further embodiment, the present invention enables the apparatus to be towed to its operating location, thus avoiding the construction of permanent structures such as davits with the common accompaniment of delay and expense of obtaining regulatory approval that such permanent structures often require, and which is modularly expandable in the field.

In another embodiment, the present invention permits moving the boat lift to more than one location, such as when a boat owner with waterfront property moves to another waterfront property.

In yet another embodiment, the present invention provides a boat lift capability that is suitable for use with a wide variety of boat weights and hull types all in a level lift configuration, including V-hulls and catamarans of a variety of lengths with a capability of handling a boat up to about 20,000 pounds presently, and with substantial addition capacity contemplated, because the design is modular to accommodate various design hulls and displacement weights.

The present invention further provides a modularly expandable floating boat lift that is operable either from within the boat or on the dock using a remote that is attachable to the key ring of the boat key or using a switch disposed within the dock box.

In another embodiment, the present invention provides a modularly expandable floating boat lift having at least one aqueous hydraulic cylinder as the power source for the boat cradle and wherein there are mechanical locking mechanisms for each aqueous hydraulic cylinder to lock the lift at the highest point to assure that pressure need not be maintained in the aqueous hydraulic cylinder(s).

In accordance with the major aspect of the invention, there are provided a plurality of modular floats that make up boat lift supporting pontoons of variable length to accommodate boats of different weight, in combination with an expandable parallelogram linkage supporting a cradle between the pontoons, which linkage is operated by at least one, and preferably by two or more aqueous hydraulic cylinders powered by a water pump and conventional controls that include a remote such as used to activate an automatic garage door opener. The water pump preferably uses household water from a hose bib which is discharged in the ambient water. Alternatively, an inlet hose disposed beneath the ambient water surface is used and equipped with a sea strainer such that the pump, solenoid valves, aqueous hydraulic cylinders and connecting hoses are kept free of debris. The water pump is preferably controlled by the remote which is attachable to the key ring of the boat or a switch in the dock box. The remote controls not only the water pump operation, but also solenoid valves in the water lines, such as between the pump and the aqueous cylinders to maintain water level in the cylinders at a fixed point. Mechanical locking mechanisms are also preferably employed to assure the boat will be maintained in its lifted position.

In operation the boat will be driven to dockside and between the pontoons. The pontoons act as guides to precisely position the boat directly over the cradle. The pump and the solenoid valves are then activated within the boat using the remote. The water pump will start and pump water into the aqueous hydraulic cylinders through the connecting hoses. The pistons of the hydraulic cylinders, which are attached to devises on the vertical legs of the parallelogram linkage, will then begin to extend the parallelogram from its collapsed configuration such that the carpeted boat bunks on the cradle come in contact with the submerged portion of the boat hull. Continued operation of the water pump raises the parallelogram linkage to its most erect configuration, such that the boat hull has been raised so that it is entirely clear of the water. The water pump is then shut off, the solenoid valves closed, and the locking mechanisms activated.

When it is desired to use the boat, the boat is boarded, the solenoid valves are initially opened to raise the boat slightly so that the locking mechanisms are withdrawn from the cylinder pistons, the solenoid valves are then activated to reverse the direction of water flow so that the single direction water pump evacuates water from the hydraulic cylinders to retract the hydraulic cylinder pistons, which collapse the parallelogram linkages and lower the boat into the water so it floats free of the cradle. The cradle is lowered to its most retracted point because the parallelogram linkage is collapsed to its maximum point. The entire apparatus disappears beneath the water except for the pontoons, mooring lines and dock box containing the water pump, solenoid, check and pressure relief valves, and related controls.

The present invention is of modular design so that the capacity of the boat lift is alterable to vary its capacity to accommodate heavier or lighter boats, which is done in the field. The distance between pontoons is adjustable, and the distance between the sides of the cradle, called boat bunks, is variable. The height of the boat bunks is indirectly variable by changing the length of vertical support columns that connect the pontoon to the remainder of the structure. The pontoons accommodate variations in the center of gravity (CG) of the boat in question by shifting the pontoons forward or aft.

The pontoons are comprised of an array of four foot long segments called modular floats having channel float beam flange tracks molded into their lower surface so they slide onto the upper flange of a supporting channel float beam. The length of the channel float beam is extendable and additional modular floats are added. The parallelogram linkage is also extendable by having additional parallelograms added along with further hydraulic cylinders. The modular floats move forward or aft to achieve level lift as a result of accommodating the boat CG. In short, then entire structure is designed to expand (or contract), and this is readily achieved in the field.

Reference will now be had to the drawings in which:

BRIEF DESCRIPTION OF THE DRAWINGS

While the specification concludes with claims defining the features of the invention that are regarded as novel, it is believed that the invention will be better understood from a consideration of the following description in conjunction with the drawing figures, in which like reference numerals are carried forward.

DETAILED DESCRIPTION OF THE PREFERRED EMBODIMENT

Figure 1:
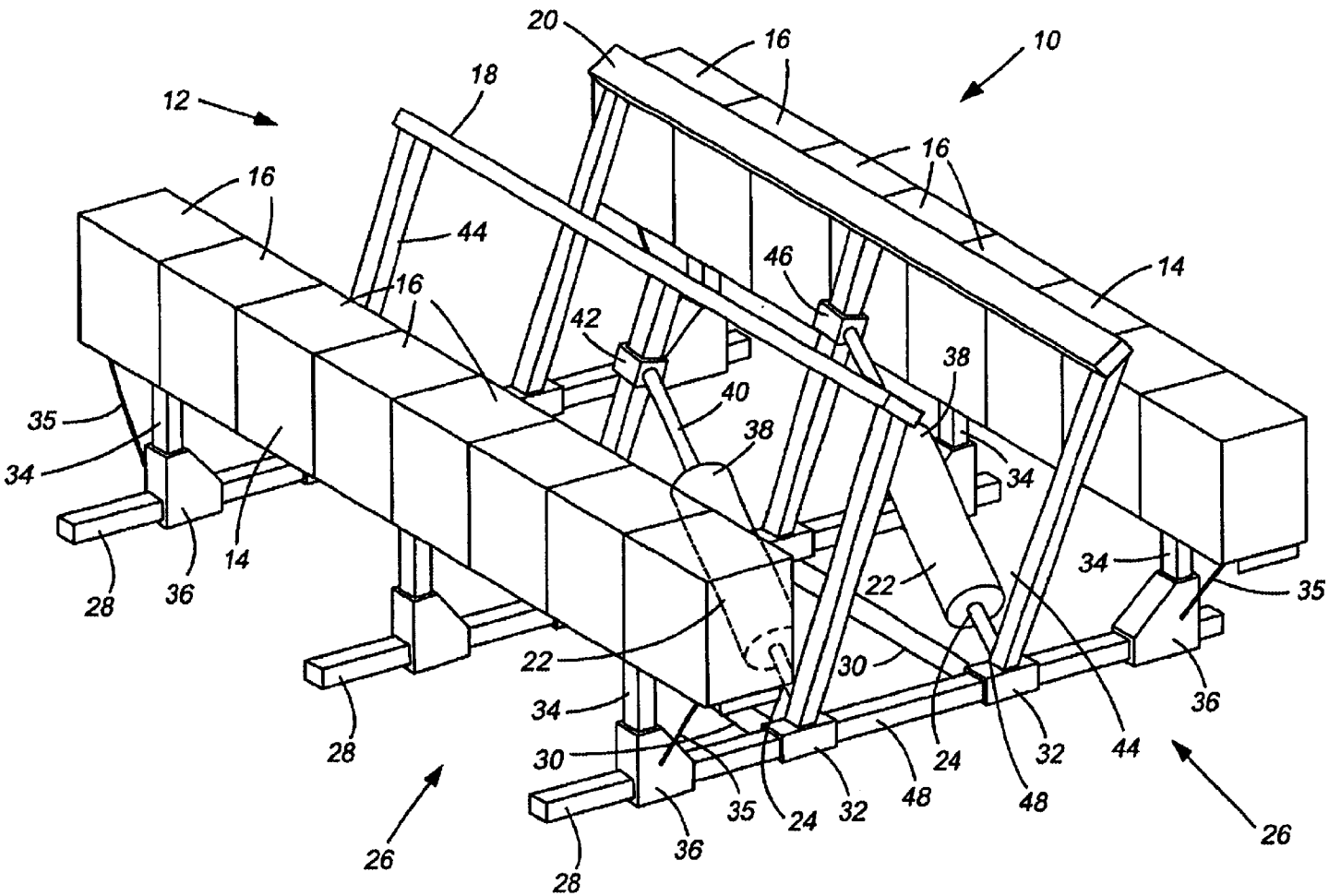
FIG. 1 is an overhead perspective view of the modular floating boat lift, with the cradle shown at its most erect position. The modular boat lift is shown for clarity without ambient water, cradle reinforcing members or a boat on the cradle.

A detailed embodiment of the present invention is disclosed herein; however, it is to be understood that the disclosed embodiments are merely exemplary of the invention which may be embodied in various forms. Therefore, specific structural and functional details disclosed herein are not to be interpreted as limiting, but merely as a basis for, the claims and as a representative basis for teaching one skilled in the art to variously employ the present invention in virtually any appropriately detailed structure. Moreover, some statements may apply to some inventive features but not to others. In general, unless otherwise indicated, singular elements may be in the plural and vice versa with no loss of generality. In these figures, for the sake of clarity, the dimensions of the various component parts shown have not been drawn to scale.

Reference now is made again to the drawings, wherein like characteristics and features of the present invention shown in the various figures are designated by the same reference numerals.

FIG. 1 is an overhead perspective view of the modular floating boat lift 10, with the cradle 12 shown at its most erect position. The modular boat lift 10 is shown for clarity without ambient water, cradle reinforcing members or a boat on the cradle. The boat lift 10 floats in water because of pontoons 14 that are comprised of a plurality of modular floats 16. The cradle 12 is comprised of boat bunks 18 and 20 which contact and support the bottom of a boat hull as seen and described later in regard to FIGS. 11 and 12. The boat bunks 18 and 20 are preferably covered with carpet to minimize marking of or damage to the hull of the boat. Although not shown, the boat bunks 18 and 20 are two or more segments hinged together to accommodate the curvature of the hull.

Figure 11:
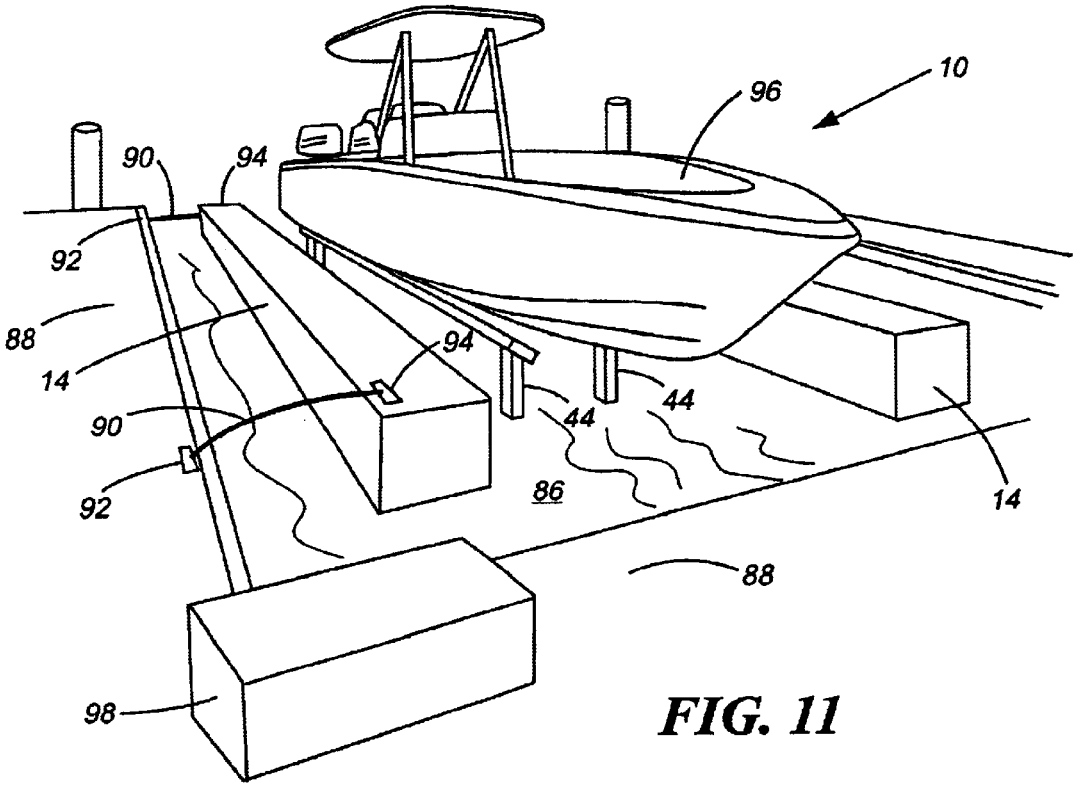
FIG. 11 is a perspective view of the modular boat lift placed in the water at a dock, with a boat raised out of the water on the lift cradle.

The cradle 12 is raised and lowered using the force of aqueous hydraulic cylinders 22 which are hingedly connected at both ends to other portions of the structure. The base end 24 of the aqueous hydraulic cylinder 22 is connected to the base structure shown generally at 26. The base structure 26 is comprised of two or more base cross beams 28 and two or more base longitudinal beams 30. The distance between the base longitudinal beams 30 is adjustable because hinged sleeve bracket 32 move left or right along base cross beams 28. The pontoons 14 are interconnected with the base cross beams 28 using vertical support columns 34. As later seen in FIG. 7 the height of the vertical support columns 34 are modifiable because doing so indirectly controls the height of the boat bunk 18 and 20. The distance between pontoons 14 is similarly adjustable because vertical sleeve brackets 36 also move left or right along the base cross beams 28. The pontoons 14 shift forward and aft to accommodate boat CG to achieve level lift, enabling the entire modular boat lift to be simply tied up to a dock with conventional mooring lines 90, as seen in FIG. 11. Level lift also avoids undesired movement of loose objects in the boat. The ends of the pontoons 14 are cantilevered from the outside vertical support columns 34, which create an upward bending moment on these cantilevered ends. This upward bending moment on the cantilevered ends is countered by wire rope or cables 35.

The upper end 38 of the aqueous hydraulic cylinders 22 includes a piston 40, which is connected at a hinge 42 to a lifting lever 44. A plurality of lifting levers 44 are disposed parallel to each other and support cradle 12 and its boat bunks 18 and 20. The combination of lifting levers 44, their hinged connection at 46 to cradle 12, and the hinged connection at 48 to the longitudinal base beams 30 form a parallelogram linkage as will be more easily seen in FIGS. 2 and 3.

Figure 2:
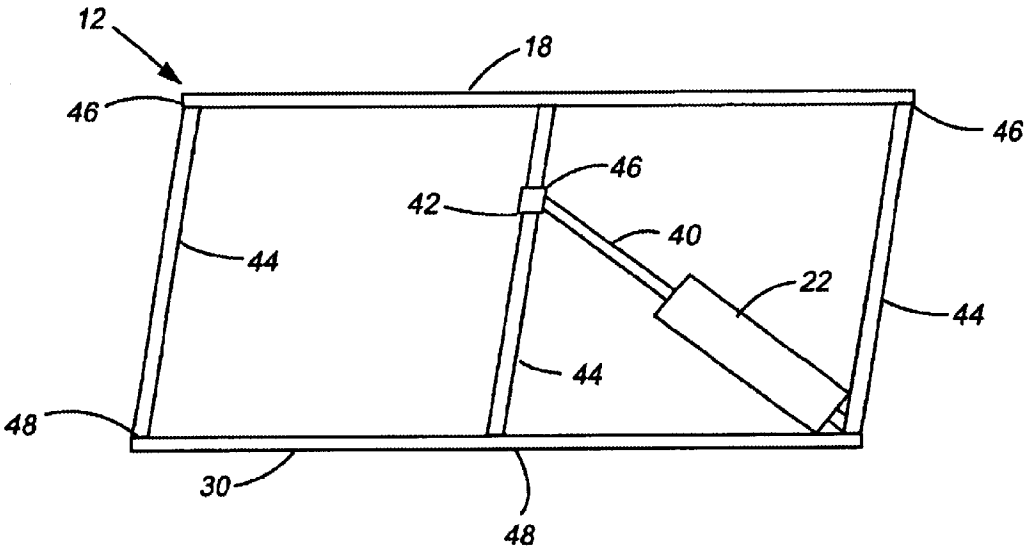
FIG. 2 is a side elevation view of the parallelogram linkage that supports the cradle of FIG. 1, but with the parallelogram linkage partially collapsed.

FIG. 2 is a side elevation view of the parallelogram linkage that supports the cradle of FIG. 1, but with the parallelogram linkage partially collapsed. Seen are lifting levers 44 disposed parallel to each other, their hinged connection at 46 to cradle 12, half of support cradle 12 comprising boat bunk 18, and the hinged connection at 48 to the longitudinal base beams 30 comprise the parallelogram linkage.

Figure 3:
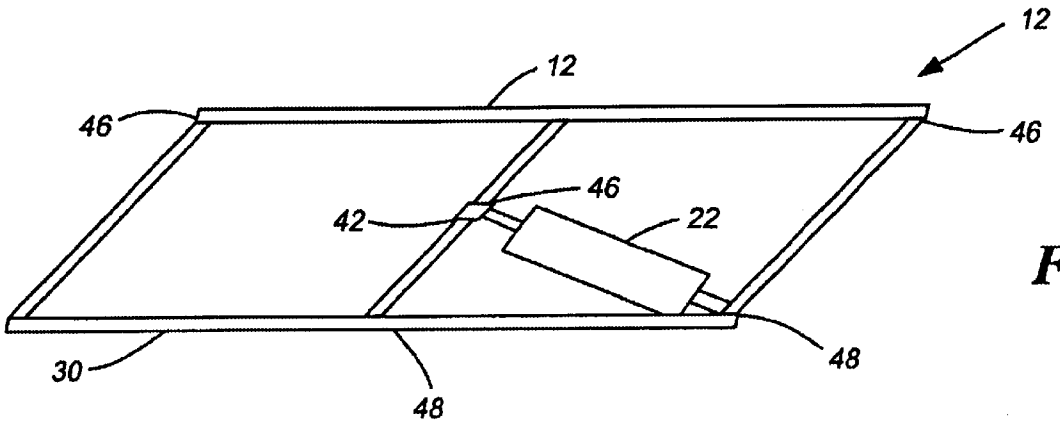
FIG. 3 is another side elevation view of the parallelogram linkage that supports the cradle of FIG. 1, but with the parallelogram linkage substantially fully collapsed.

FIG. 3 is another side elevation view of the parallelogram linkage that supports the cradle of FIG. 1, but with the parallelogram linkage substantially filly collapsed. The same parts are seen as illustrated in FIG. 2.

Figure 4:
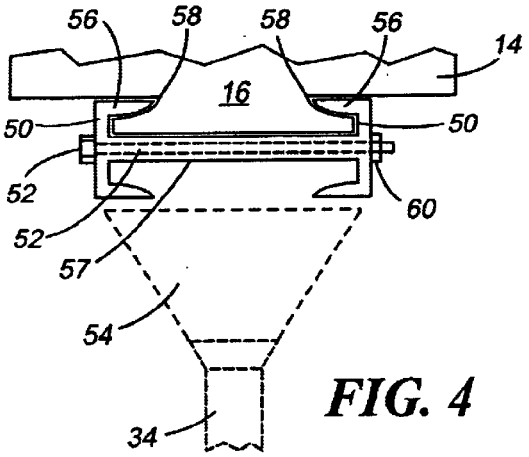
FIG. 4 is a broken end view of one of the pontoons as seen in FIG. 1 showing its support by channel float beams in spaced relationship using a long bolt, spacer, and with the vertical support column shown in phantom.

FIG. 4 is a broken end view of one of the pontoons 14 as seen in FIG. 1 showing its support by channel float beams 50 in spaced relationship using a long bolt 52, preferably eighteen inches, and hollow spacer 57. Also seen are flange 56 of the channel float beam 50 disposed within a mating groove 58 of the end modular float 16 of the pontoon 14, and also showing how the channel float beam 50 is supported and positioned on the long bolt 52 by nut 60. Washers of conventional design are also used but are not shown. A unique feature of the present invention is the fact that the flange 56 of the channel float beam 50 constitutes a sliding track which operates in relationship with the mating groove 58 of the modular floats 16 for initial assembly of modular boat lift 10, and for modular enlargement or contraction of the lift as needed. Floats are adjusted forward or aft relative to the boat position to properly locate the CG of the boat. The invention includes specific instructions on how to establish the CG of the boat and adjust the floats forward or aft. This feature permits level lift, leading to at least two advantages. The first is that the modular boat lift 10 is simply tied to a dock with conventional mooring lines. The second is that level lift means loose objects in the boat, such as the personal possessions of the boat users do not have to be secured or tied down. Vertical support column 34 and vertical support column bracket 54 are also shown in phantom.

Figure 5:
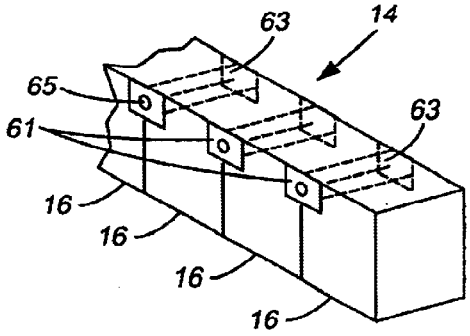
FIG. 5 is a broken enlarged perspective view of a portion of a pontoon showing how the tops of the adjoining floats are attached to each other.

FIG. 5 is a broken enlarged view of pontoon 14 showing a plurality modular floats 16. At the top of the modular floats 16 are disposed face plates 61 on all four upper corners of each float. Passing between each pair of adjacent floats are float rods 63 seen in phantom, and attached to the face plates 61 at bolt 65.

Figure 6:
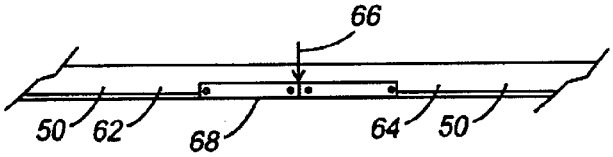
FIG. 6 is a broken front elevation view of a channel float beam showing that the various beams in the structure of FIG. 1 are also modular, being a series of pieces held together with joining plates bolted to the pieces.
Figure 7:
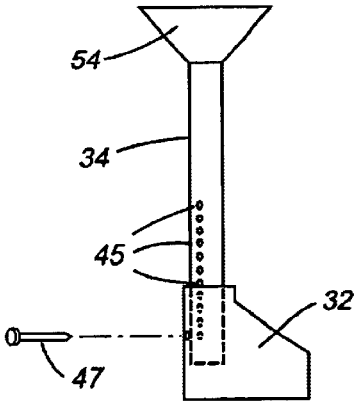
FIG. 7 is a vertical support column showing it is perforated along the lower portion of its length so that its length is alterable using a bolt that attaches it to the base structure.

FIG. 6 is a broken font elevation view of a channel float beam 50 showing that the various beams in the structure of FIG. 1 are also modular, being a series of pieces 62 and 64 held together at a joint 66 with joining plates 68 bolted to the pieces 62 and 64. While FIG. 6 shows a channel float beam 50, it is intended to illustrate that this principle is applied throughout the entire structure of the modular boat lift, since the same result is achieved with such things as boat bunks 18 and 20, base cross beams 28, and base longitudinal beams 30. This is, of course, part of what makes the design truly modular. Other features that contribute to that achievement are the fact that the pontoons are comprised of modular floats 16, the modular floats are adjustable forward and aft to accommodate boat CG so level lift is achieved allowing the modular boat lift 10 to be simply secured with mooring lines 90 and avoiding shifting of loose objects on board the boat, the distance between the base longitudinal beams 30 is adjustable, the distance between pontoons 14 is adjustable, and the height of the boat bunks 18, 20 is similarly adjustable. This latter feature results from the fact that the vertical support column 34 as seen in FIG. 7 is perforated along the lower portion of its length 45 so that its length is alterable using a bolt 47 that attaches it to hinged sleeve bracket 32. The effect of changing the length of vertical support columns 34 is to change the vertical position of the pontoons 14 relative to the remainder of the structure. Since the entire modular boat lift 10 floats in ambient water 86 as seen in FIG. 11, changing the vertical position of the pontoons 14 results in changing the height of the boat bunks 18 and 20.

This concept of modularity is of importance to the industry of boat lifts because of the commonly known fact that boat owners keep buying bigger and heavier boats and they don't want to have to keep buying completely new boat lifts.

The same concept is of importance to the patentability of this invention because modularity is not found anywhere in the prior art known to Applicant.

Figure 8:
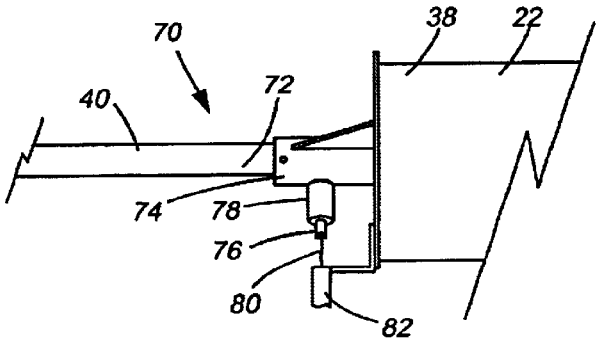
FIG. 8 is a broken enlarged view of the end of a aqueous hydraulic cylinder showing the operating portion of the locking mechanism to fix the cylinder piston in the extended position so that a boat raised on the lift is positively secured in that position without regard to the maintenance of pressure in the hydraulic cylinder.
Figure 12:
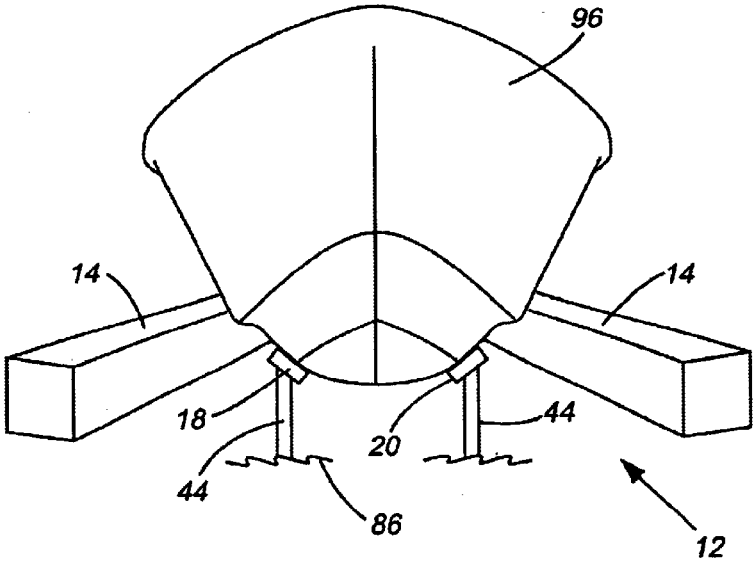
FIG. 12 is a front elevation view, looking slightly upward and showing the support of the boat of FIG. 11 high and dry on the cradle.

FIG. 8 is a broken enlarged view of the upper end 38 of one of the aqueous hydraulic cylinders 22 showing the operating portion of the locking mechanism 70 to fix the cylinder piston 40 in the extended position so that a boat raised on the lift is positively secured in that position without regard to the maintenance of pressure in the hydraulic cylinder 22. Cylinder piston 40 includes a shallow bore 72, but in FIG. 8 piston 40 is hyperextended just to reveal shallow bore 72. In practice, it would not be seen because the farthest out it would travel would be inside housing 74, where it would be disposed in registration with pin member 76 when the cylinder piston 40 is fully extended. This condition of a fully extended cylinder piston 40 corresponds to the raising of the parallelogram linkage to its maximum height, which in turn means that the boat lift 10 has raised the boat high and dry out of the water as shown in FIGS. 11 and 12. Pin member 76 slides up and down in tube 78 to go in and out of shallow bore 72. Tube 78 is welded to housing 74. The position of pin member 76 is determined by its connection to cable 80. Cable 80 moves within cable sheathing 82. While FIG. 8 shows the locking mechanism at one hydraulic cylinder 22, the same structure is repeated at each hydraulic cylinder 22.

Figure 9:
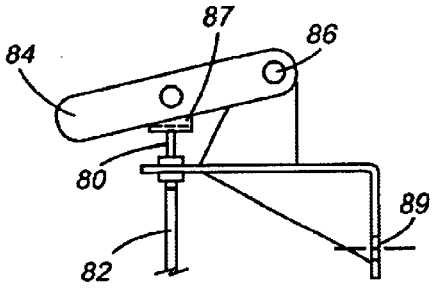
FIG. 9 is a side elevation view of the control lever that directs the operation of the locking mechanism of FIG. 8.

FIG. 9 is a side elevation view of a control lever 84 that directs the operation of the locks of the locking mechanism 70 of FIG. 8. Control lever 84 pivots about axle 86 and is connected to the opposite end of cable 80. Cable 80 is disposed within cable sheathing 82. Thus, by moving control lever 84 up or down, cable 80 moves pivoting member 76 such that stud 74 engages and disengages with shallow bore 72, thereby locking and unlocking the fully extended cylinder piston 40 of aqueous hydraulic cylinder 22. Again, this is typical of the control levers that operate locking mechanisms at each hydraulic cylinder 22. Included is bore 89 suitable for mounting control lever 84 to float rods 63 and bolts 65 at face plates 61 as seen in FIG. 5. Boat lift cleats 94 for mooring lines 90 to position the modular boat lift 10 in respect to dock 88 are seen in FIG. 11, but it is useful to know that boat lift cleats 94 are similarly attached to pontoons 14 using float rods 63 and bolts 65 at face plates 61 as seen in FIG. 5.

Figure 10:
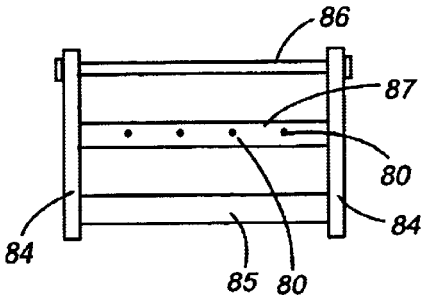
FIG. 10 is a top plan view of the control lever of FIG. 9 showing the handle and cable connecting cross member that controls the position of the cables which in turn direct the operation of the locking mechanism of FIG. 8.

FIG. 10 is a top plan view of the control lever 84 of FIG. 9 showing the handle 85 and cable connecting cross member 87 that controls the position of the cables 80 which in turn direct the operation of the locking mechanisms of FIG. 8. In this instance, four cables 80 are shown on connecting cross member 87 because the unit in question has four hydraulic cylinders.

FIG. 11 is a perspective view of the modular boat lift 10 placed in the water 86 at a dock 88. The modular boat lift 10 is shown positioned and retained using mooring lines 90 tied to dock cleats 92 and boat lift cleats 94, but it will be understood that other means are available to hold the modular boat lift. This includes, but is not limited to, mooring whips, pilings, anchors, and various fixed or floating structures. A boat 96 is shown raised high and dry out of the water 86 on the lift cradle 12 supported by lift levers 44. A dock box 98 is shown on dock 88. Dock box 98 contains a plurality of components relating to the operation of the modular boat lift 10, which are schematically described in FIG. 13.

FIG. 12 is a front elevation view of the boat 96 from the bow, looking slightly upward, and illustrating the support of the boat 96 of FIG. 11 high and dry on the cradle 12. In this view boat bunks 18 and 20 are seen supported on the upper ends of lift levers 44 above the surface of the water 86.

Figure 13:
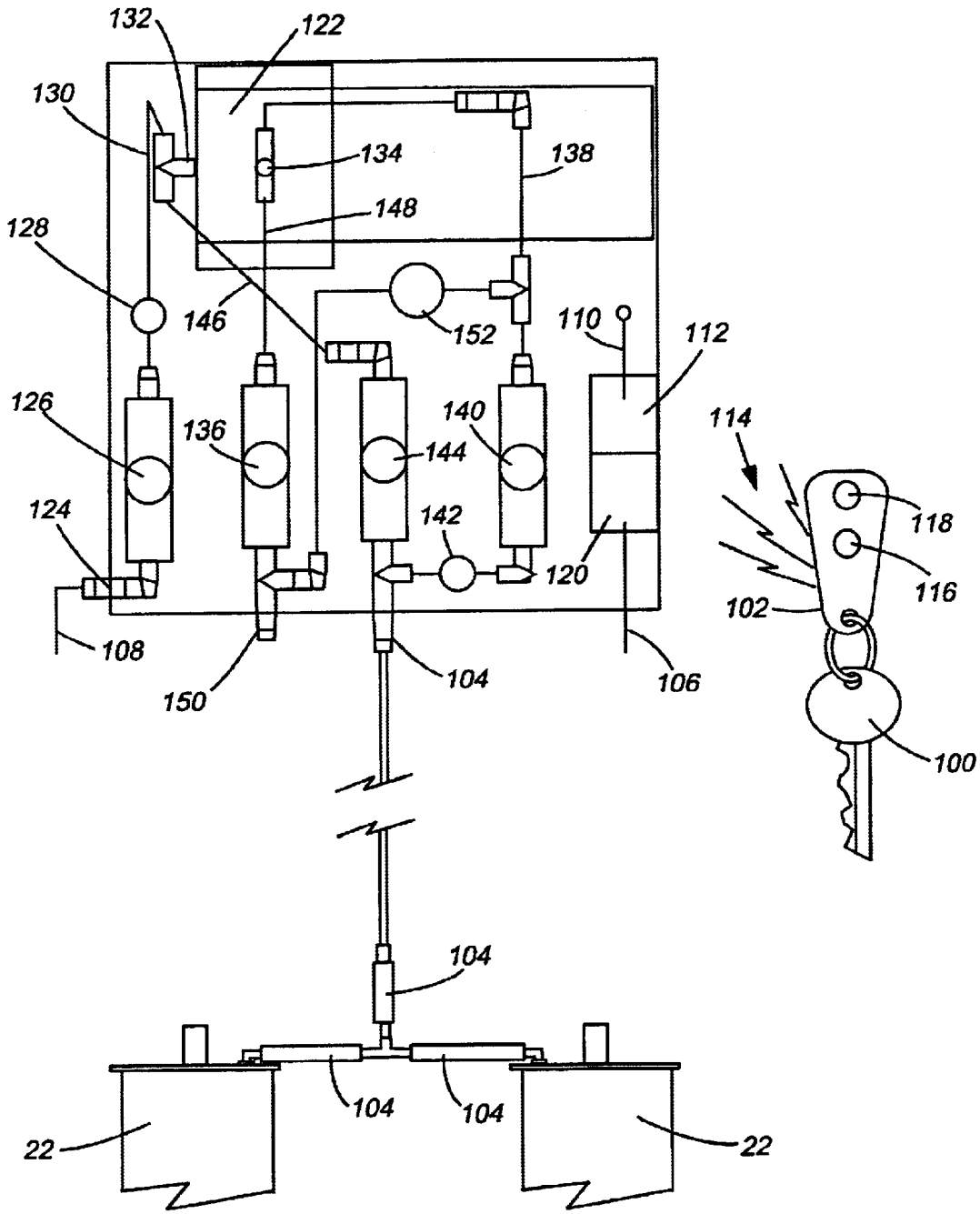
FIG. 13 is a schematic drawing of the dock box, its connection to the hydraulic cylinders, and the key with remote, the latter of which operates the lift.

Turning finally to FIG. 13, dock box 98 is schematically shown, with components contained therein also illustrated schematically. Also seen is boat key 100 with remote 102. Remote 102 is one way to control the contents of the dock box 98, the other being a manual switch of conventional nature and not shown. Further illustrated is water piping 104 to aqueous hydraulic cylinders 22 shown in broken view, incoming electrical power 106 and incoming household water 108.

The dock box 98 also contains an RF (Radio Frequency) antenna 110 and receiver 112 for receiving RF signals 114 from the remote 102, which is equipped with up 116 and down 118 buttons. The RF antenna 110 and receiver 112 are connected to an electrical switch 120. Electrical switch 120 is in electrical communication to various electrical components in the dock box, including especially water pump 122, through conventional power lines not shown. Electrical switch 120 also includes a conventional timer that shuts off everything five (5) minutes after a boat has been lowered into the ambient water. Since water pump 122 operates only in one direction, reversing its pumping direction is accomplished with piping and solenoid valves, as now described.

Tracking downstream from incoming water 108 inlet 124 is disposed solenoid valve 126 to close off and open the water line 108 from inlet 124. The solenoid valve 126 is controlled by electrical switch 120. Downstream of solenoid valve 126 there a check valve 128 to ensure that water does not back up from solenoid valve 144, whose function and location are later described.

Following after check valve 128, water line 130 connects to pump 122 inlet tee 132. After water passes through pump 122, it is discharged through outlet tee 134. Inlet tee 132 and outlet tee 134 accept and direct water respectively depending upon which solenoid valves are opened or closed for the purpose of pumping water into or out of aqueous hydraulic cylinders 22. For example, when solenoid valve 136 is closed, outlet tee 134 is directed along water line 138 to solenoid valve 140, which is open when solenoid valve 136 is closed and water is being pumped to the cylinders 22 through water lines 104. After exiting solenoid valve 140, a check valve 142 prevents back flow to the pump 122.

When it is desired to evacuate water from the hydraulic cylinders 22, solenoid valves 126 and 140 are closed. Solenoid valves 144 and 136 are opened. Water in water lines 104 then passes through solenoid valve 144, and water line 146 to pump 122 inlet tee 132, through pump 122, through outlet tee 134, water line 148, through solenoid valve 136 to discharge 150. Note that regardless of whether water pump 122 is pumping water into the cylinders 22 as when solenoid valves 126 and 140 are open, or out of the cylinders 22 as when solenoid valves 144 and 136 are open, water always passes through the pump 122 in the same direction, i.e., from inlet tee 132 to outlet tee 134. Therefore, when filling the cylinders solenoid valves 126 and 140 are open, solenoid valves 144 and 136 are closed, and vice versa. Dock box 98 also contains a pressure relief valve 152, which is interposed between water line 138 and discharge 150 to prevent over pressuring the system when pumping water into the cylinders 22.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teaching herein are particularly reserved especially as they fall within the breath and scope of the claims hereto appended.

What is claimed is:

1. A boat lift comprising:

at least one parallelogram linkage supporting a cradle of boat bunks, the at least one parallelogram linkage including at least one aqueous hydraulic cylinder;

a plurality of pontoons for floating the boat lift on a water surface;

a base structure supporting the at least one parallelogram linkage and the plurality of pontoons, the base structure including beams made of a series of beam pieces such that lengths of the beams can be altered by changing a number of beam pieces using joining plates to thereby create a modular base structure, wherein the modular base structure facilitates field alterations; and a plurality of channel float beams supporting the pontoons, the pontoons being of alterable length and movable position, by altering a number of modular floats used in the pontoons thereby allowing the boat lift to accommodate boats of different weights and to accommodate level lifting of boats with variable centers of gravity.

2. A boat lift comprising:

at least one parallelogram linkage supporting a cradle of boat bunks, the at least one parallelogram linkage including at least one aqueous hydraulic cylinder, the cradle having boat bunks being of alterable length;

a plurality of channel float beams that support a plurality of pontoons that float the boat lift on a water surface, the pontoons being of alterable length by altering a number of modular floats used in the pontoons thereby allowing the boat lift to accommodate boats of different weights;

a base structure supporting the at least one parallelogram linkage and the plurality of pontoons, the base structure including beams made of a series of beam pieces such that lengths of the beams can be altered by adding or removing beam pieces using joining plates to thereby create a modular base structure wherein the modular base structure facilitates field alterations, the beams including vertical support columns, base cross beams and base longitudinal beams of alterable length, wherein the base cross beams and base longitudinal beams support the at least one parallelogram linkage I which supports the cradle of boat bunks and wherein a distance between the base longitudinal beams adjustable thereby making a distance between the boat bunks adjustable such that different boat weights and hull shapes can be accommodated between the boat bunks, wherein the vertical support columns support the pontoons, and wherein a distance between the vertical support columns is adjustable thereby making a distance between the pontoons adjustable to accommodate different boat weights, wherein shifting forward and aft the modular floats allows for level lifting of boats with variable centers of gravity, wherein varying a number of parallelogram linkages and aqueous hydraulic cylinders accommodates boats of different weights.

3. A method of employing a boat lift, the method comprising:

assembling at least one aqueous hydraulic cylinder powered parallelogram linkage supporting a cradle of boat bunks and pontoons for floating the boat lift on a water surface;

varying capacity of the boat lift to accommodate boats of different weights using a modular base structure to facilitate field alterations of the boat lift by altering a number of beam pieces to beams of the base structure using joining plates;

altering a length of channel float beams that support the pontoons by-altering a number of modular floats used in the pontoons and thus varying a weight of boat that can be lifted; and shifting forward and aft the modular floats to accommodate boats of varying centers of gravity to achieve level lift.

4. A method of employing a boat lift, the method comprising:

assembling at least one aqueous hydraulic cylinder powered parallelogram linkage supporting a cradle of boat bunks and pontoons for floating the boat lift on a water surface;

varying capacity of the boat lift to accommodate boats of different weights using a modular base structure to facilitate field alterations of the boat lift by altering a number of beam pieces to beams of the base structure by using joining plates to add or remove the beam pieces;

wherein varying capacity of the boat lift includes altering a length of base cross beams and base longitudinal beams of the base structure;

altering a length of the cradle having boat bunks;

altering a length of channel float beams that support the pontoons by-altering a number of modular floats used in the pontoons and thus varying a weight of boat that can be lifted;

shifting forward and aft modular floats on the channel float beams to achieve level lifting of boats with varying centers of gravity;

wherein the base cross beams and base longitudinal beams support the at least one parallelogram linkage which supports the cradle of boat bunks and wherein hinged sleeve brackets interconnect the base longitudinal beams and base cross beams such that the base longitudinal beams can be moved left or right along base cross beams;

adjusting a distance between the base longitudinal beams to alter a distance between the boat bunks such that different sized boat hulls can be accommodated between the boat bunks;

wherein the base structure includes vertical support columns attached to the pontoons and wherein the vertical support columns are interconnected by vertical sleeve brackets with the base cross beams such that the vertical support columns can be moved left or right along bass cross beams;

adjusting a distance between the vertical support columns to alter a distance between the pontoons to accommodate different sized boats; and varying a number of parallelogram linkages and aqueous hydraulic cylinders to accommodate boats of different weights and sizes.

5. A boat lift comprising:

a base structure;

a cradle connected with the base structure and configured to support a boat;

a plurality of pontoons connected with the base structure for floating the boat lift on a water surface, the pontoons including a plurality of modular floats;

at least one parallelogram linkage for raising and lowering the cradle, the at least one parallelogram linkage connected with the base structure;

wherein the modular floats are attachable and detachable such that boats of varying weights are lifted; and wherein the base structure includes a plurality of beam pieces, the beam pieces being attachable and detachable to make a modular base structure.

6. The boat lift of claim 5 wherein the at least one parallelogram linkage is made of a series of beam pieces such that the beam pieces of the parallelogram linkage are attachable and detachable to make at least one modular parallelogram linkage.

7. The boat lift of claim 6 wherein the at least one modular parallelogram linkage includes at least one aqueous hydraulic cylinder.

8. A method of employing the boat lift of claim 7, the method comprising:

altering a number of the aqueous hydraulic cylinders coupled to the modular parallelogram linkage to change the capacity of the boat lift.

9. A method of employing the boat lift of claim 6, the method comprising:

altering a number of beam pieces forming the modular parallelogram linkage to change the capacity of the boat lift.

10. A method of employing the boat lift of claim 5, the method comprising:

altering a number of modular floats forming the pontoons to change the capacity of the boat lift.

11. A method of employing the boat lift of claim 5, the method comprising:

altering a number of beam pieces forming the modular base structure to change the capacity of the boat lift.

12. A boat lift comprising:

a base structure;

a cradle connected with the base structure and configured to support a boat;

a plurality of pontoons connected with the base structure for floating the boat lift on a water surface, the pontoons including a plurality of modular floats; and at least one parallelogram linkage for raising and lowering the cradle, the at least one parallelogram linkage connected with the base structure;

wherein the base structure includes a plurality of beam pieces, the beam pieces being attachable and detachable to make a modular base structure and wherein the modular floats are movable forward and aft with respect to the cradle such that boats of varying centers of gravity are lifted levelly.

13. The boat lift of claim 12 wherein the at least one parallelogram linkage is made of a series of beam pieces such that the beam pieces of the parallelogram linkage are attachable and detachable to make at least one modular parallelogram linkage.

14. The boat lift of claim 13 wherein the at least one modular parallelogram linkage includes at least one aqueous hydraulic cylinder.

15. A method of employing the boat lift of claim 14, the method comprising:

altering a number of the aqueous hydraulic cylinders coupled to the modular parallelogram linkage to change the capacity of the boat lift.

16. A method of employing the boat lift of claim 13, the method comprising:

altering number of beam pieces to or from the modular parallelogram linkage to change the capacity of the boat lift.

17. A method of employing the boat lift of claim 12, the method comprising:

moving forward and aft the modular floats forming the pontoons with respect to the cradle such that boats of varying centers of gravity can be lifted levelly.

18. A method of employing the boat lift of claim 12, the method comprising:

altering a number of beam pieces to or from the modular base structure to change the capacity of the boat lift.

* * * * *